US005664815A

United States Patent [19]

Kornder

[11] Patent Number: 5,664,815

[45] Date of Patent: Sep. 9, 1997

[54] EARTHQUAKE SAFETY DEVICE FOR DUAL CABINET DOORS

[76] Inventor: Joe Kornder, 6725 Yates Ave., San Bernardino, Calif. 92404

[21] Appl. No.: 681,394

[22] Filed: Jul. 23, 1996

[51] Int. Cl.[6] ..... E05C 19/18

[52] U.S. Cl. ..... 292/288; 292/156; 292/DIG. 21

[58] Field of Search ..... 292/289, 288, 292/300, 258, 156, 162, DIG. 21

[56] References Cited

U.S. PATENT DOCUMENTS

| | | | |
|---|---|---|---|
| 359,815 | 3/1887 | Sargent | 292/289 |
| 694,975 | 3/1902 | Marshall | 292/289 |
| 2,151,587 | 3/1939 | Cassileth | 292/288 |
| 2,899,229 | 8/1959 | Jenks | 292/288 |
| 2,924,476 | 2/1960 | Deane | 292/288 |
| 3,147,030 | 9/1964 | Berk | 292/288 |
| 3,206,793 | 9/1965 | Silverberg | 292/288 |
| 4,004,833 | 1/1977 | Hull | 292/288 |
| 4,082,334 | 4/1978 | Yolta et al. | 292/288 |
| 4,372,136 | 2/1983 | Mickelson | 292/288 |
| 4,389,862 | 6/1983 | Hastings | 292/288 |
| 4,605,251 | 8/1986 | Finlay | 292/288 |
| 4,770,450 | 9/1988 | Dacus | 292/288 |
| 4,955,648 | 9/1990 | Miller | 292/288 |
| 5,203,597 | 4/1993 | Wheelock | 292/288 |
| 5,209,533 | 5/1993 | Menard | 292/288 |
| 5,294,160 | 3/1994 | Arthur | 292/288 |

*Primary Examiner*—Rodney M. Lindsey
*Attorney, Agent, or Firm*—Douglas Weller

[57] ABSTRACT

A safety device (10) for securing dual adjacent cabinet doors, each having a door handle or door knob. The safety device (10) is made of a single rigid rod (10*a*) made of substantially inflexible, durable material, forming an elongated arm (11) with perpendicularly depending legs (12, 13) with tip ends (12*b*, 13*b*) covered by resilient enlargements (14, 15).

2 Claims, 5 Drawing Sheets

EARTHQUAKE SAFETY DEVICE FOR DUAL CABINET DOORS

BACKGROUND—FIELD OF INVENTION

The present invention relates to security devices for dual adjacent cabinet doors that have door handles or knobs which are adjacent near the inside edges of the dual doors.

BACKGROUND—DESCRIPTION OF PRIOR ART

Interior cabinet doors as described above are commonly equipped with a magnetic latch, a spring-type latch, or a spring-type hinge, the purpose of which is to keep the cabinet door in a closed position under normal circumstances.

When an earthquake or other activity causes unusual movement or shifting of the cabinet or of the cabinet's contents, common latching mechanisms will not secure the cabinet doors, allowing the cabinet doors to fly open and the cabinet contents to fall or be thrown out. Such falling or flying objects invariably break or are damaged and may also cause physical harm to persons in the area. The danger to persons and the resulting breakage or other damage to property can be prevented or minimized if cabinet doors remain secure regardless of the forces acting on them.

Various security devices exist for securing duel doors. The patent to Marshall U.S. Pat. No. 694,975, issued Mar. 11, 1902, for Shutter Holder, discloses a link with longitudinally spaced, transversely extending slots at the ends of the link for placement behind rings of double shutters. It was heretofore known to employ a metal plate with longitudinally spaced, transversely extending slots for placement between the interior portions of double doors and interior knobs fixed to respective adjacent double doors.

The patent to Jenks U.S. Pat. No. 2,899,229, issued on Aug. 11, 1959, for Child Proof Cabinet Lock, shows a coil spring with hook ends to encircle door operating hardware.

The patent to Volta et al. U.S. Pat. No. 4,082,334, issued on Apr. 4, 1978, for Interior Security Device for Double Doors, shows a metallic plate with longitudinally spaced slots to receive the neck or narrow portions of adjacent door knobs.

The patent to Arthur U.S. Pat. No. 5,294,160, issued Mar. 15, 1994, discloses a rigid plate disposed between two parallel planes with openings spaced apart from one another to receive the neck or narrow portion of adjacent door knobs and a pin inserted diagonnally to prevent the plate from being lifted off.

Other patents of interest are:

U.S. Pat. No. 694,975;

U.S. Pat. No. 2,151,587;

U.S. Pat. No. 4,770,450;

U.S. Pat. No. 4,955,648.

The devices referenced above that relate specifically to securing dual adjacent cabinet doors are typically fairly expensive to manufacture, cumbersome to use, useful only for certain or specific types of handles or knobs, unsightly, and capable of marring the surface of the cabinet door. Said devices may require exact or near-exact tolerances in manufacture and may not provide sufficient security (safety) in the event of an earthquake or other event involving unusual force or movement.

OBJECTS AND ADVANTAGES

There is a need for a safety (security) device for dual cabinet doors which (1) is inexpensive to manufacture;

(2) is not required to meet strict tolerance requirements;

(3) is easy to install and remove;

(4) will not damage or scratch the surface of the cabinet door;

(5) does not detract from the beauty of the cabinet doors;

(6) is lightweight and easy to store; and (7) provides a strong measure of safety by effectively securing doors during an earthquake or event involving unusual force or movement.

It is an object of the present invention to provide a safety device for dual adjacent cabinet doors that satisfies the aforementioned needs.

A safety device according to the present invention secures dual adjacent cabinet doors, each having a door handle or door knob. A safety device having features of the present invention comprises a single rigid rod forming an elongated arm with a perpendicularly depending leg at each end. In use, the device straddles the handles or knobs which are adjacent near the inside edges of dual cabinet doors. The device need not fit tightly in place and is toleranced loosely, allowing for easy installation or removal and for some variances in door structure designs and dimensions.

The tip end of each depending leg is encased by a resilient enlargement to prevent the rigid tip end from making contact with and damaging the surfaces of the cabinet door or the handles or knobs and to dampen sound and vibrations.

DRAWING FIGURES

These and other features, aspects, and advantages of the present invention will be understood more readily from a reading of the following specification and by reference to the accompanying drawings where:

REFERENCE NUMERALS AND LETTERS IN DRAWINGS

| | | | |
|---|---|---|---|
| 10 | safety device | 10a | rigid rod |
| 11 | arm | 12 | leg |
| 12a | point of bend | 12b | tip end |
| 13 | leg | 13a | point of bend |
| 13b | tip end | 14 | resilient enlargement |
| 15 | resilient enlargement | 16 | cabinet door |
| 17 | cabinet door | 18 | handle |
| 18a | handle grip area | 19 | handle |
| 19a | handle grip area | 20 | upper mounting surface |
| 21 | upper mounting surface | 22 | lower mounting surface |
| 22a | point | 23 | lower mounting surface |
| 23a | point | 24 | cabinet door |
| 25 | cabinet door | 26 | door knob |
| 27 | door knob | 28 | door knob neck |
| 29 | door knob neck | s | distance |
| ss | distance | t | distance |
| tt | distance | x | distance |
| xx | distance | y | distance |
| yy | distance | | |

DESCRIPTION—FIGS. 1–6

Figure 1:
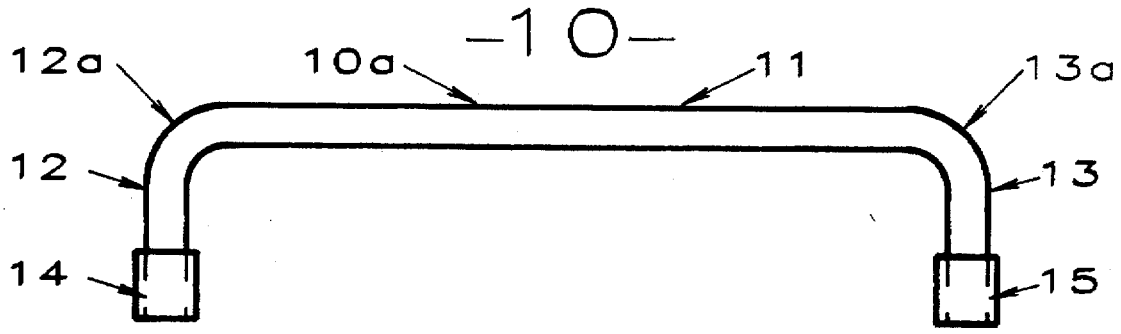
FIG. 1 shows a safety device having features of the present invention.

FIG. 1—The Safety Device, Front View

Figure 2:
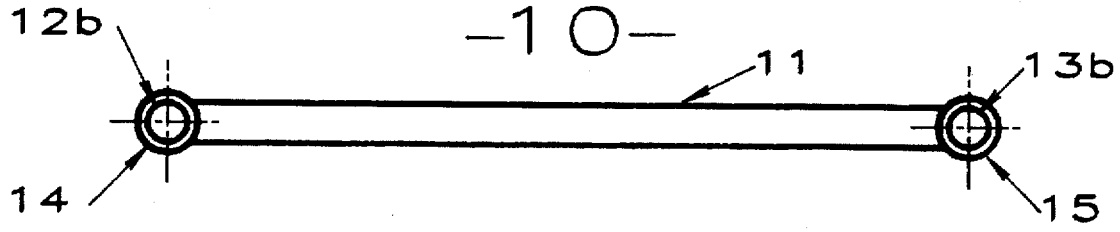
FIG. 2 is a bottom view of the safety device of FIG. 1.

FIG. 2—The Safety Device, Bottom View

Illustrated in FIG. 1 and FIG. 2 is a safety device 10 embodying the present invention, for securing dual adjacent cabinet doors, each having a door handle or door knob. The safety device 10 comprises a single rigid rod 10*a* forming an elongated arm 11 with perpendicularly depending legs 12 and 13 at each end and resilient enlargements 14 and 15 that cover tip ends 12*b* and 13*b* of perpendicularly depending legs 12 and 13. The single rigid rod 10*a* is made of substantially inflexible, durable material such as metal or hard plastic. The safety device is shaped from the single rod 10*a* by bending or molding each end so that leg 12 forms a right angle to arm 11 at point 12*a* and leg 13 forms a right angle to arm 11 at point 13*a*. The resilient enlargements 14 and 15 are made of substantially resilient material such as soft plastic, vinyl, or rubber.

Figure 3:
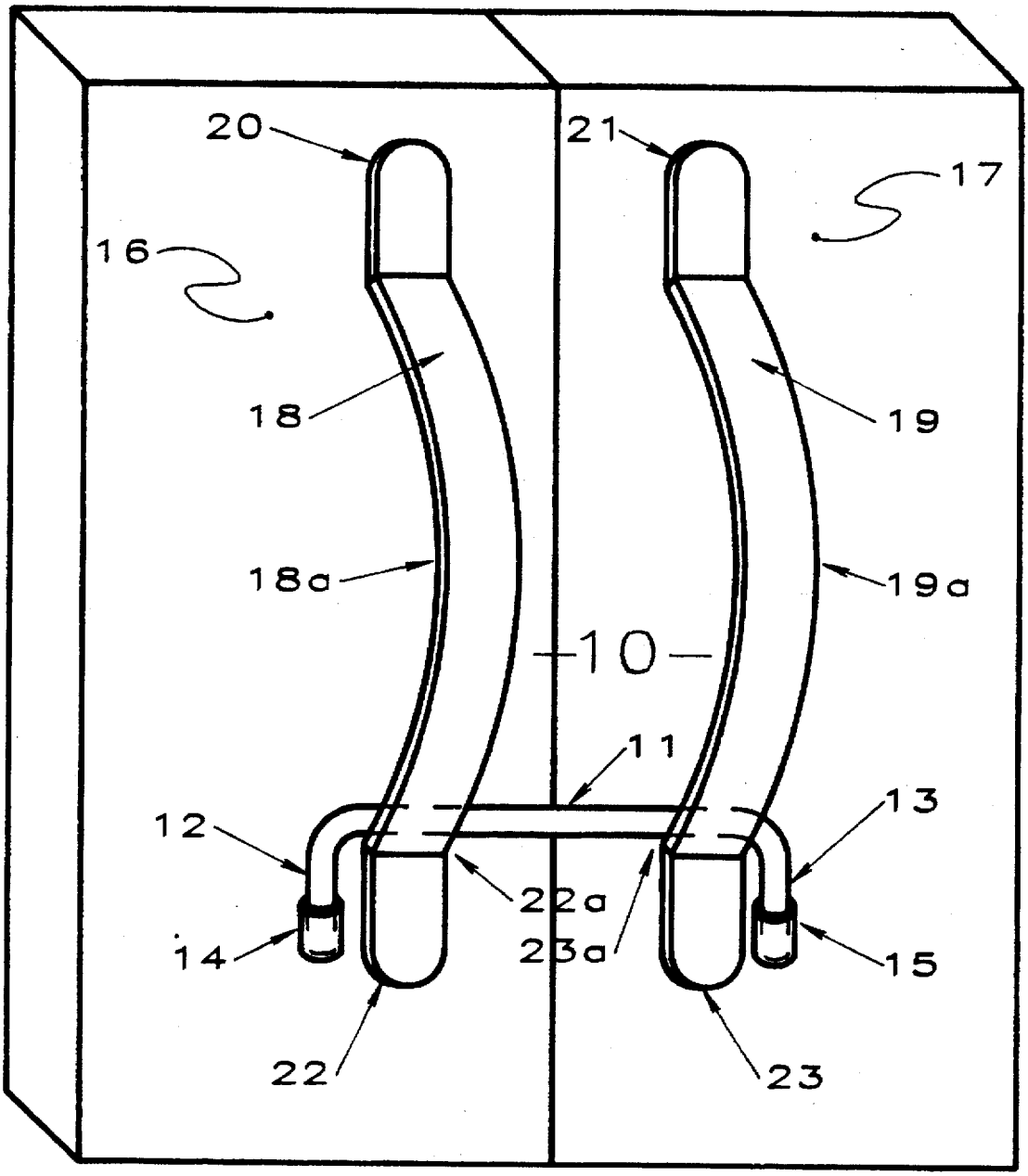
FIG. 3 shows the safety device of FIG. 1 installed on dual adjacent cabinet doors having door handles.

FIG. 3—The Safety Device in Use on Dual Adjacent Cabinet Doors with Handles, Front View Illustrated in FIG. 3 is the safety device 10 embodying the present invention in position securing dual adjacent cabinet doors 16 and 17 with handles 18 and 19. Cabinet door handle 18 is secured to cabinet door 16 at upper mounting surface 20 and lower mounting surface 22. Cabinet door handle 19 is secured to cabinet door 17 at upper mounting surface 21 and lower mounting surface 23. The safety device 10 straddles cabinet door handles 18 and 19 so that the elongated arm 11 lies horizontally between the door handles 18 and 19, resting atop the inner surface of cabinet door handles 18 and 19 at points 22*a* and 23*a* where the lower mounting surfaces 22 and 23 abut cabinet doors 16 and 17. Legs 12 and 13 extend perpendicularly downward outside lower mounting surfaces 22 and 23.

Figure 4:
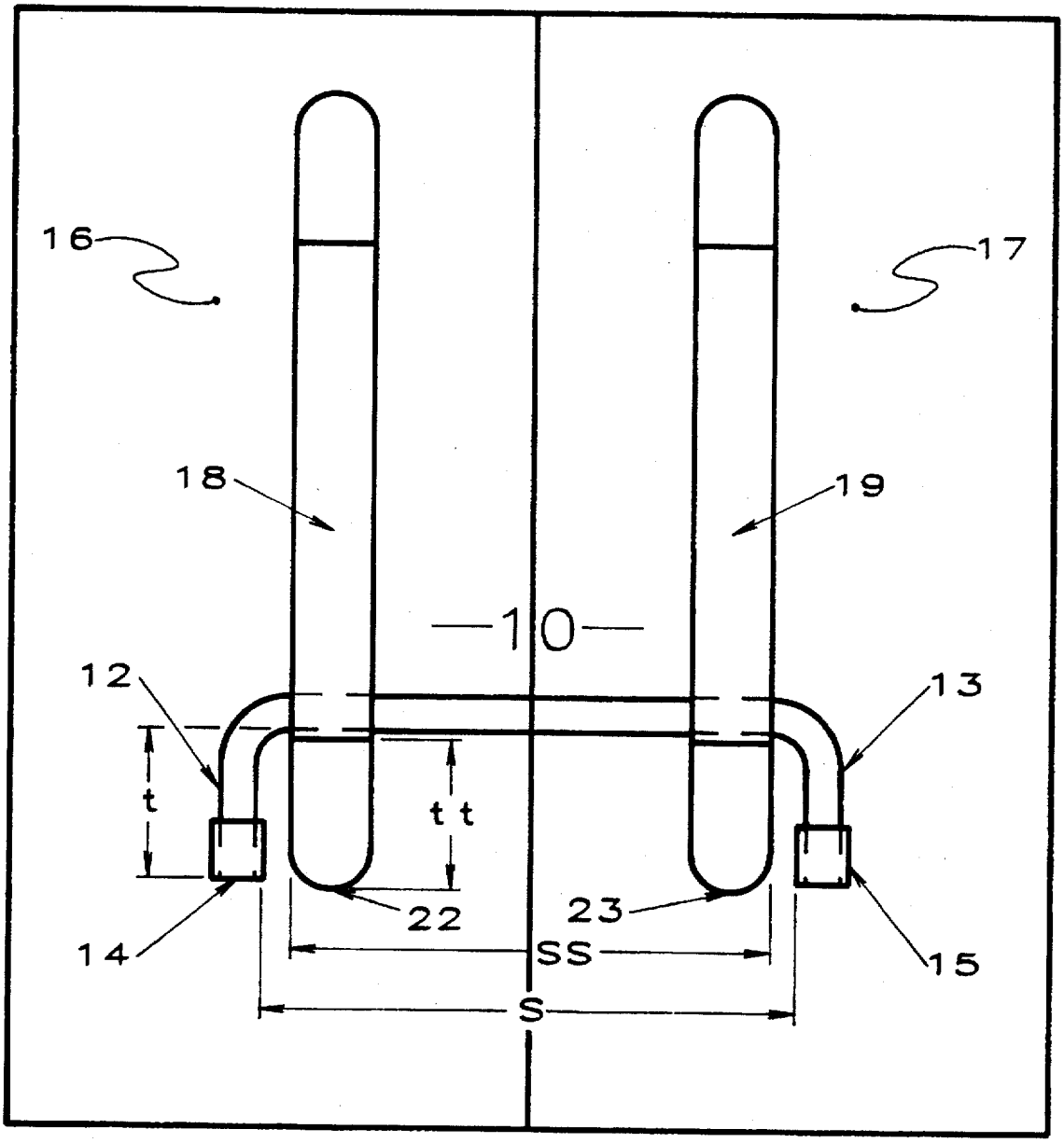
FIG. 4 is the same view as FIG. 3, showing the relative dimensions of the safety device.

FIG. 4—The Safety Device in Use on Dual Adjacent Cabinet Doors with Handles, Showing Relative Dimensions of the Safety Device The safety device 10 is constructed so that the opening between depending legs 12 and 13, which is the distance s between the inside edges of resilient enlargements 14 and 15, is slightly wider than the distance s s between the outer edges of handle lower mounting surfaces 22 and 23. This configuration allows the safety device 10 to fit loosely astraddle the cabinet door handles for easy installation and removal without requiring exact tolerances in construction. This configuration also allows the safety device 10 to be in place without being obtrusive or detracting from the appearance of the cabinet or cabinet hardware. The resilient enlargements 14 and 15 at the end of depending legs 12 and 13 rest against cabinet doors 16 and 17, preventing the rigid tip ends of the depending legs of the safety device from making contact with and damaging the surfaces of the cabinet doors or the handles or knobs and dampening any sound or vibrations.

The safety device 10 is constructed so that the length of depending leg 12, which is distance t, is approximately the same as or slightly longer than distance t t, the length of lower mounting surface 22. The same relative dimensions apply to depending leg 13 and lower mounting surface 23. This configuration and the weight of the safety device 10 allow the safety device 10 to remain in place in the event of an earthquake or other event involving unusual force or movement without requiring exact tolerances in construction. Its limited size also allows the safety device 10 to be in place without being obtrusive or detracting from the appearance of the cabinet or cabinet hardware.

Figure 5:
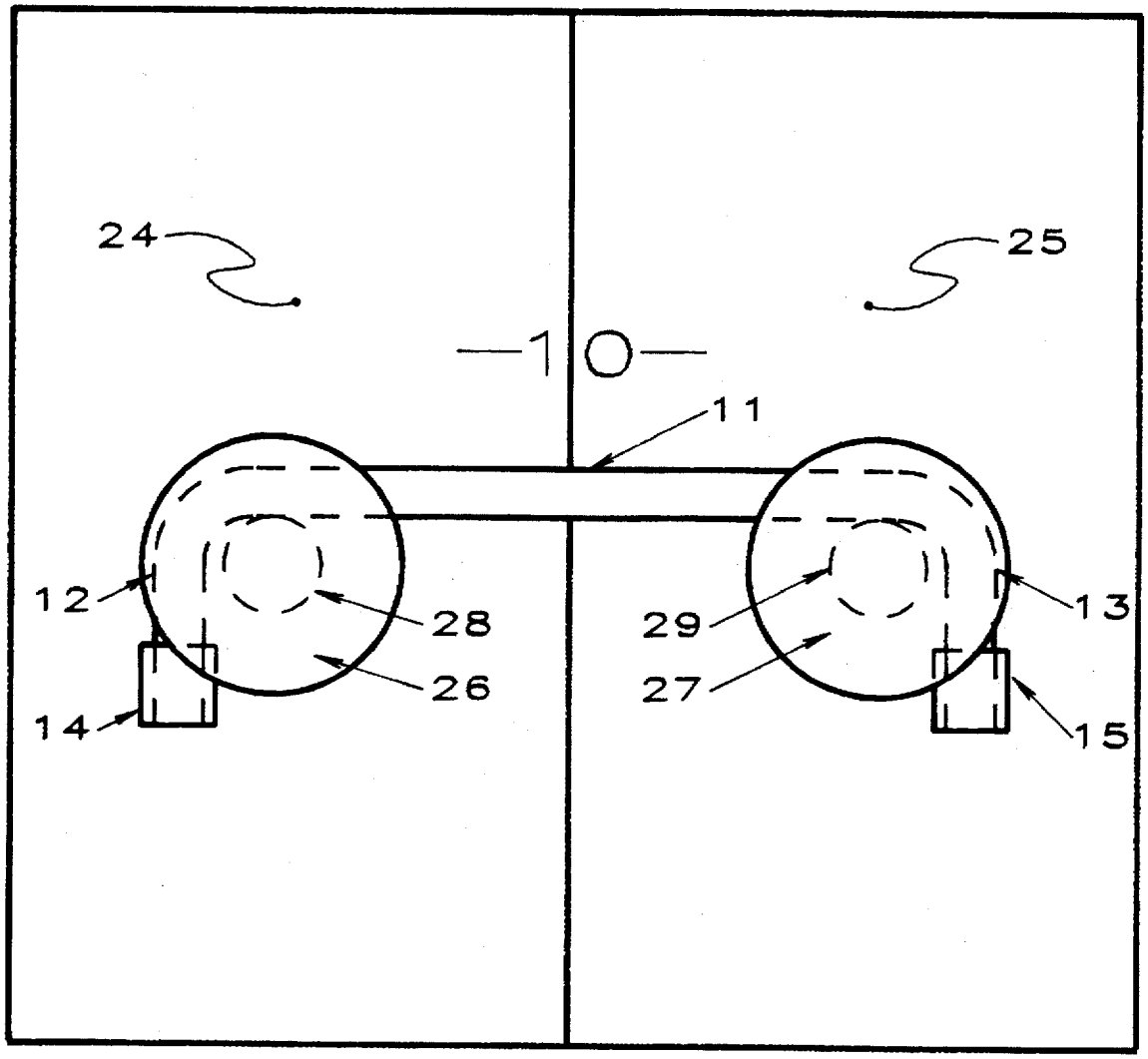
FIG. 5 shows the safety device of FIG. 1 installed on dual adjacent cabinet doors having door knobs.

FIG. 5—The Safety Device in Use on Dual Adjacent Cabinet Doors with knobs, Front View Illustrated in FIG. 5 is the safety device 10 embodying the present invention in position securing dual adjacent cabinet doors 24 and 25 with knobs 26 and 27. Knob 26 is secured to cabinet door 24 at knob neck 28. Knob 27 is secured to cabinet door 25 at knob neck 29. The safety device 10 straddles knobs 26 and 27 so that the elongated arm 11 lies horizontally between knobs 26 and 27, resting atop knob necks 28 and 29. Legs 12 and 13 extend perpendicularly downward outside knob necks 28 and 29.

Figure 6:
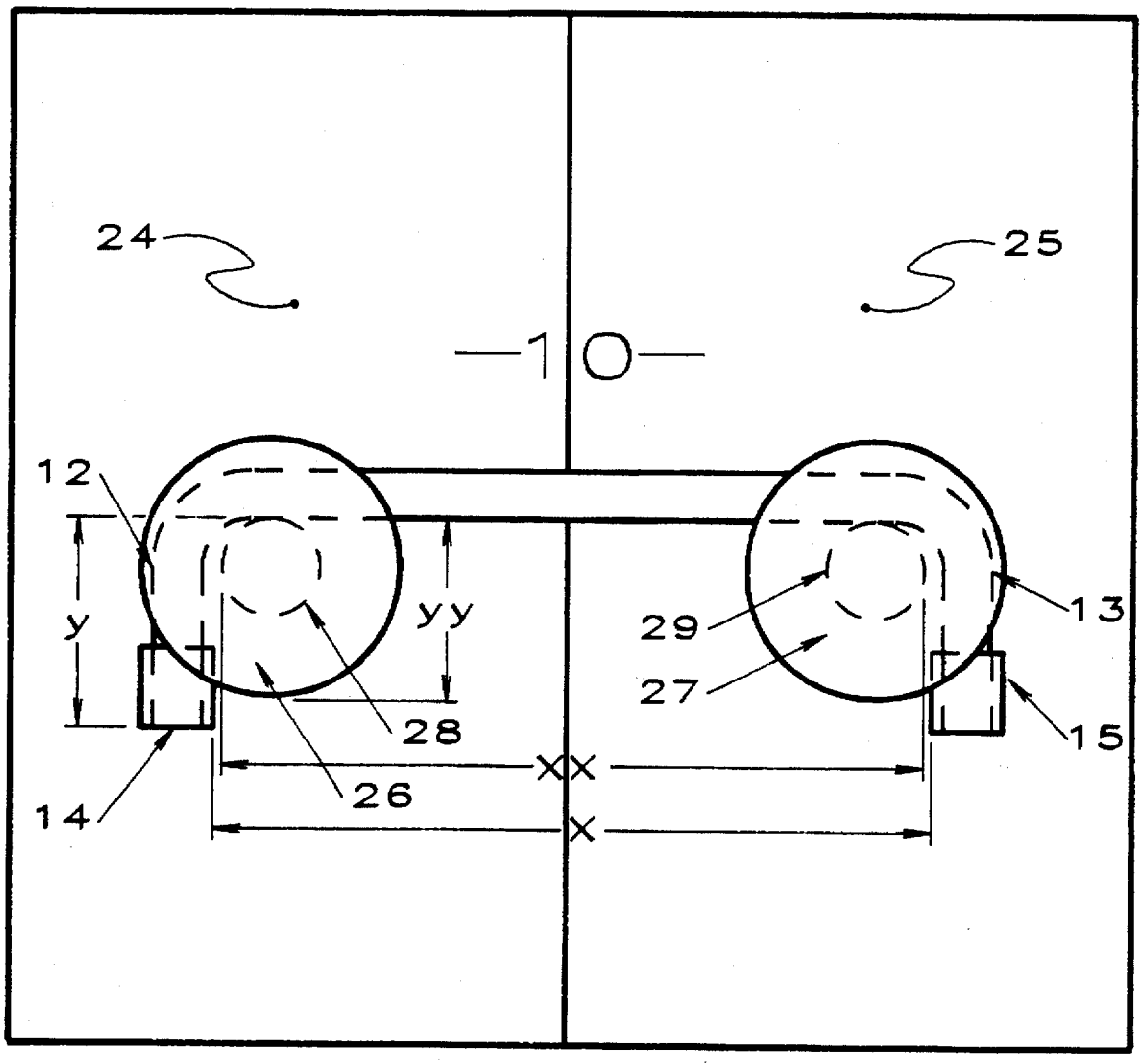
FIG. 6 is the same view as FIG. 5, showing the relative dimensions of the safety device.

FIG. 6—The Safety Device in Use on Dual Adjacent Cabinet Doors with Knobs, Showing Relative Dimensions of the Safety Device The safety device 10 is constructed so that the opening between depending legs 12 and 13, which is the distance x between the inside edges of the resilient enlargements 14 and 15, is slightly wider than the distance x x between the outer edges of knob necks 28 and 29. This configuration allows the safety device 10 to fit loosely astraddle the cabinet door handles for easy installation and removal without requiring exact tolerances in construction. This configuration also allows the safety device 10 to be in place without being obtrusive or detracting from the appearance of the cabinet or cabinet hardware. The resilient enlargements 14 and 15 at the end of the depending legs 12 and 13 rest against the cabinet doors 24 and 25, preventing the rigid tip ends from making contact with and damaging the surfaces of the cabinet doors or the handles or knobs and dampening any sound or vibrations.

The safety device 10 is constructed so that the length of leg 12, which is distance y, is approximately the same as or slightly longer than distance y y, which is the distance between the top of knob neck 28 and the bottom of door knob 26. The same relative dimensions apply to leg 13, knob neck 29, and door knob 27. This configuration and the weight of the safety device 10 allow the safety device 10 to remain in place in the event of an earthquake or other event involving unusual force or movement without requiring exact tolerances in construction. Its limited size also allows the safety device 10 to be in place without being obtrusive or detracting from the appearance of the cabinet or cabinet hardware.

Operation—FIGS. 3, 5

Installation of the safety device 10 for FIG. 3 is simple and quick. The safety device 10 is held between the door handles 18 and 19 by the elongated arm 11 and tilted so that leg 12 passes through the space between handle grip area 18*a* and cabinet door 16 and then leg 13 passes through the space between handle grip area 19*a* and cabinet door 17. The safety device 10 is then set in place so that the elongated arm 11 rests atop lower mounting surfaces 22 and 23 at points 22*a* and 23*a* and the resilient enlargements 14 and 15 rest against cabinet doors 16 and 17. Cabinet doors 16 and 17 are now secured against coming open in the event of an earthquake or other event involving unusual force or movement.

Installation of the safety device 10 for FIG. 5 is simple and quick. The safety device 10 is set in place so that the elongated arm 11 rests atop knob necks 28 and 29 and the legs 12 and 13 extend perpendicularly down along the outside of knob necks 28 and 29 and the resilient enlargements 14 and 15 rest against cabinet doors 24 and 25. The cabinet doors 24 and 25 are now secured against coming open in the event of an earthquake or other event involving unusual force or movement.

Summary, Ramifications, and Scope

Accordingly, the reader will see that the present invention, the Earthquake Safety Device for Dual Cabinet Doors, can be used to secure dual cabinet doors against opening in the event of an earthquake or other event involving unusual force or movement. The present invention has advantages in that it is inexpensive and simple to manufacture;

it is not required to meet strict tolerance requirements;

it is easy to install and remove;

it will not damage or scratch the surface of the cabinet door;

it will not damage or scratch the door handles or door knobs;

it does not detract from the beauty of the cabinet doors;

it is lightweight and easy to store;

it provides a measure of safety by effectively securing doors during an earthquake or event involving unusual force or movement.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A safety device equipped cabinet comprising:

a first cabinet door, the first cabinet door having a first door handle, the first door handle including, a first upper mounting surface attached to the first cabinet door at a first upper location, a first lower mounting surface attached to the first cabinet door at a first lower location, the first lower location being below the first upper location, and a first handle grip, attached to the first upper mounting surface and to the first lower mounting surface, the first handle grip being shaped so that a first space exists between the first handle grip and the first cabinet door;

a second cabinet door, the second cabinet door having a second door handle, the second door handle including, a second upper mounting surface attached to the second cabinet door at a second upper location, a second lower mounting surface attached to the second cabinet door at a second lower location, the second lower location being below the second upper location, and a second handle grip, attached to the second upper mounting surface and to the second lower mounting surface, the second handle grip being shaped so that a second space exists between the second handle grip and the second cabinet door; and, a removable safety device for engaging about the first and second handle grips within the first space and the second including, an elongated arm having a first end and a second end, a first leg attached to the first end of the elongated arm, the first leg extending straight out from the first end in a direction perpendicular to the elongated arm, a tip end of the first leg being encased by first resilient protective material, and a second leg attached to the second end of the elongated arm, the second leg extending straight out from the second end in the direction perpendicular to the elongated arm, a tip end of the second leg being encased by second resilient protective material;

wherein when the removable safety device is in a secure position, the removable safety device straddles the first mounting surface and the second mounting surface so that a first portion of the elongated arm within the first space between the first handle grip and the first cabinet door rests on the first lower mounting surface, a second portion of the elongated arm within the second space between the second handle grip and the second cabinet door rests on the second lower mounting surface, the first leg extends down alongside the first lower mounting surface so that the first resilient protective material rests against the first cabinet door, and the second leg extends down alongside the second lower mounting surface so that the second resilient protective material rests against the second cabinet door.

2. A safety device equipped cabinet comprising:

a first cabinet door, the first cabinet door having a first door handle, the first door handle including, a first mounting surface attached to the first cabinet door, a first knob, and a first neck, the first neck connecting the first mounting surface to the first knob;

a second cabinet door, the second cabinet door having a second door handle, the second door handle including, a second mounting surface attached to the second cabinet door, a second knob, and a second neck, the second neck connecting the second mounting surface to the second knob;

a removable safety device for engaging about the first and second handles, including, an elongated arm having a first end and a second end, a first leg attached to the first end of the elongated arm, the first leg extending straight out from the first end in a direction perpendicular to the elongated arm, a tip end of the first leg being encased by first resilient protective material, and a second leg attached to the second end of the elongated arm, the second leg extending straight out from the second end in the direction perpendicular to the elongated arm, a tip end of the second leg being encased by second resilient protective material;

wherein when the removable safety device is in a secure position, the removable safety device straddles the first door handle and the second door handle so that a first portion of the elongated arm rests on the first neck, a second portion of the elongated arm rests on the second neck, the first leg extends down alongside the first lower mounting surface so that the first resilient protective material rests against the first cabinet door, and the second leg extends down alongside the second mounting surface so that the second resilient protective material rests against the second cabinet door.

* * * * *